US007387540B1

(12) United States Patent
Van der Steen

(10) Patent No.: US 7,387,540 B1
(45) Date of Patent: Jun. 17, 2008

(54) ELECTRICAL CONNECTOR ASSEMBLY HAVING IMPROVED TERMINAL

(75) Inventor: Henrikus P. G. Van der Steen, Den Dungen (NL)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/633,918

(22) Filed: Dec. 5, 2006

(51) Int. Cl.
*H01R 24/00* (2006.01)

(52) U.S. Cl. ..... 439/660; 439/566; 439/570

(58) Field of Classification Search ..... 439/74, 439/660, 570, 566
See application file for complete search history.

(56) References Cited

U.S. PATENT DOCUMENTS 5,120,256 A * 6/1992 Walden ..... 439/553
5,545,051 A * 8/1996 Summers et al. ..... 439/350
5,836,773 A * 11/1998 McHugh et al. ..... 439/74
5,876,217 A * 3/1999 Ito et al. ..... 439/74
5,928,003 A * 7/1999 Kajinuma ..... 439/74
5,931,689 A * 8/1999 Patel ..... 439/346
6,645,005 B2 * 11/2003 Wu ..... 439/563
6,881,075 B2 * 4/2005 Huang et al. ..... 439/74
2004/0058568 A1 * 3/2004 Ye et al. ..... 439/74

FOREIGN PATENT DOCUMENTS

JP 1176233 7/1989

* cited by examiner

*Primary Examiner*—Neil Abrams
*Assistant Examiner*—Harshad C Patel
(74) *Attorney, Agent, or Firm*—Wei Te Chung

(57) ABSTRACT

An electrical connector assembly (100) for connecting a pair of separated circuit boards, includes a male connector (10) and a female connector (20) respectively for electrically connecting to the two circuit boards. The male connector includes a plug insulator (1) and a number of male terminals (3) each provided with an engaging portion (32). The female connector includes a receptacle insulator (2) and a number of female terminals (4). Each female terminal is formed with a contact portion (43) contacting with corresponding engaging portion of the male terminal, a horizontal resilient beam (42) and a bended compressible portion (43) resiliently connecting to the resilient beam for providing sufficient elasticity to the female terminal.

20 Claims, 21 Drawing Sheets

ELECTRICAL CONNECTOR ASSEMBLY HAVING IMPROVED TERMINAL

BACKGROUND OF THE INVENTION

1. Field of the Invention

The present invention relates to an electrical connector assembly having a male connector and a female connector capable of mating with each other and connectable to a pair of separated PCBs (printed circuit boards) respectively for electrical connection between the PCBs.

2. Description of Related Art

Generally, an electrical connector connectable to a pair of separated PCBs for electrically connecting between the PCBs is required in personal computers, mobile phones or the likes.

A conventional board-to-board connector is described in U.S. Pat. No. 6,881,075, which was issued on Apr. 19, 2005. The board-to-board connector comprises a plug connector provided with a plug portion and a plurality of male terminals, and a receptacle connector mated with the plug connector and provided with a plurality of female terminals. Each male terminal is configured as an L shape, comprising a body portion, an engaging portion perpendicular to the body portion, and a tail portion extending horizontally from a free end of the body portion for soldering onto a PCB. Each female terminal is formed with a body portion, a contact portion rising perpendicular from a free end of the body portion for contacting with the engaging portion of the male terminal, an insertion portion perpendicular to the body portion, and a soldering tail extending outwardly for soldering on to another PCB.

The contact portion connected to the body portion directly could not get sufficient elasticity so that it is easy to have a deformation of the female terminal.

Hence, an improved electrical connector is required to overcome the above-mentioned disadvantages of the related art.

SUMMARY OF THE INVENTION

A primary object of the present invention is to provide an electrical connector assembly having a plurality of improved female terminals, which have sufficient elasticity to securely engage with a mating connector.

To achieve the aforementioned objects, an electrical connector assembly for connecting a pair of separated PCBs comprises a male connector and a female connector respectively connected to the two PCBs. The male connector comprises a plug insulator and a plurality of male terminals each provided with an engaging portion. The female connector comprises a receptacle insulator and a plurality of female terminals. Each female terminal is formed with a contact portion contacting with corresponding engaging portion of the male terminal, a horizontal resilient beam and a bended compressible portion resiliently connecting to the resilient beam for providing sufficient elasticity to the female terminal.

It is hard to have a deformation of the female terminals due to the sufficient elasticity provided by the compressible portions, during the process of mating the two connectors. The female terminals could be protected from having a distort, when the two connectors are mated for many times.

Other objects, advantages and novel features of the invention will become more apparent from the following detailed description of a preferred embodiment when taken in conjunction with the accompanying drawings.

BRIEF DESCRIPTION OF THE DRAWINGS

FIG. 15 is a cross-sectional view of the assembled electrical connector assembly similar to FIG. 12, with the plug terminals shown in FIG. 13 and the female terminals shown in FIG. 14 being assembled to;

FIG. 18 is a perspective view of the male connector and the female connector in accordance with the third embodiment, with the first and the second locking portions being mounted on;

DETAILED DESCRIPTION OF THE INVENTION

Figure 1:
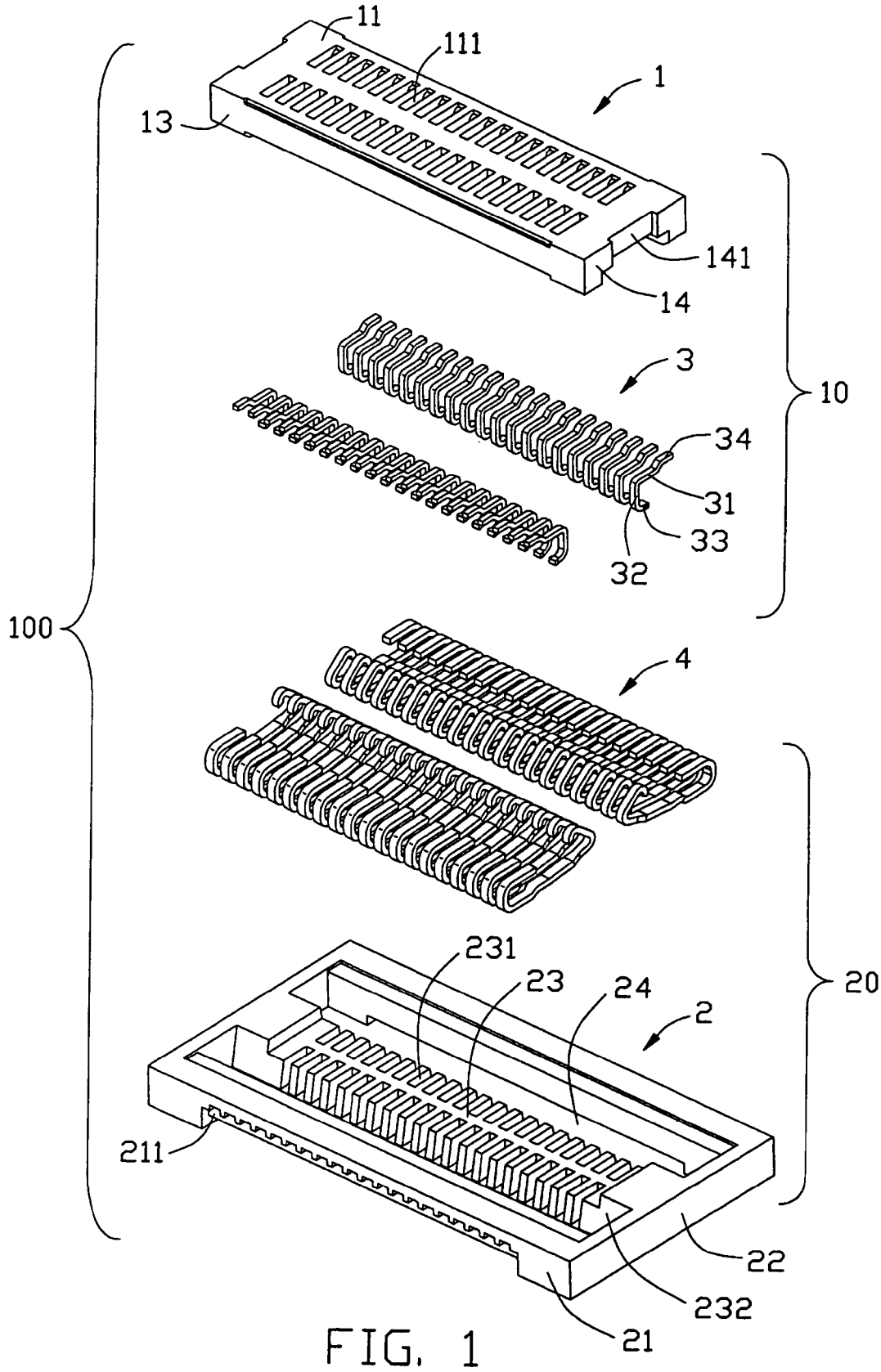
FIG. 1 is an exploded perspective view of an electrical connector assembly in accordance with a first embodiment of the present invention.

Reference will now be made to the drawing figures to describe the present invention in detail. Referring to FIG. 1, an electrical connector assembly 100 in accordance with the preferred embodiment of the present invention comprises a male connector 10 and a detachable female connector 20 respectively connectable to a first PCB (not shown) and a second PCB (not shown) for electrically connection between the two PCBs.

The male connector 10 comprises a plug insulator 1, two rows of male terminals 3 longitudinally arranged in the plug insulator 1 at regular intervals.

Figure 2:
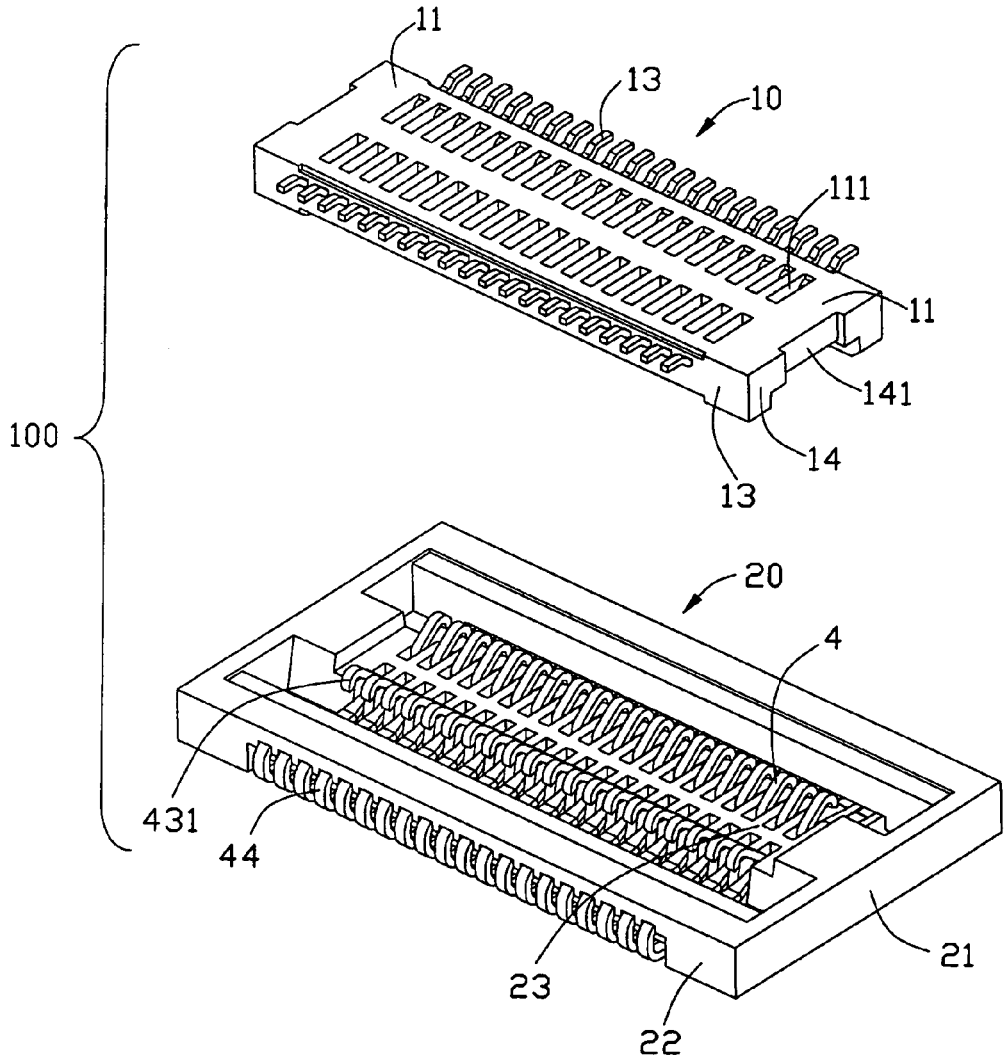
FIG. 2 is a perspective view of an assembled male connector and an assembled female connector as shown in FIG. 1.
Figure 3:
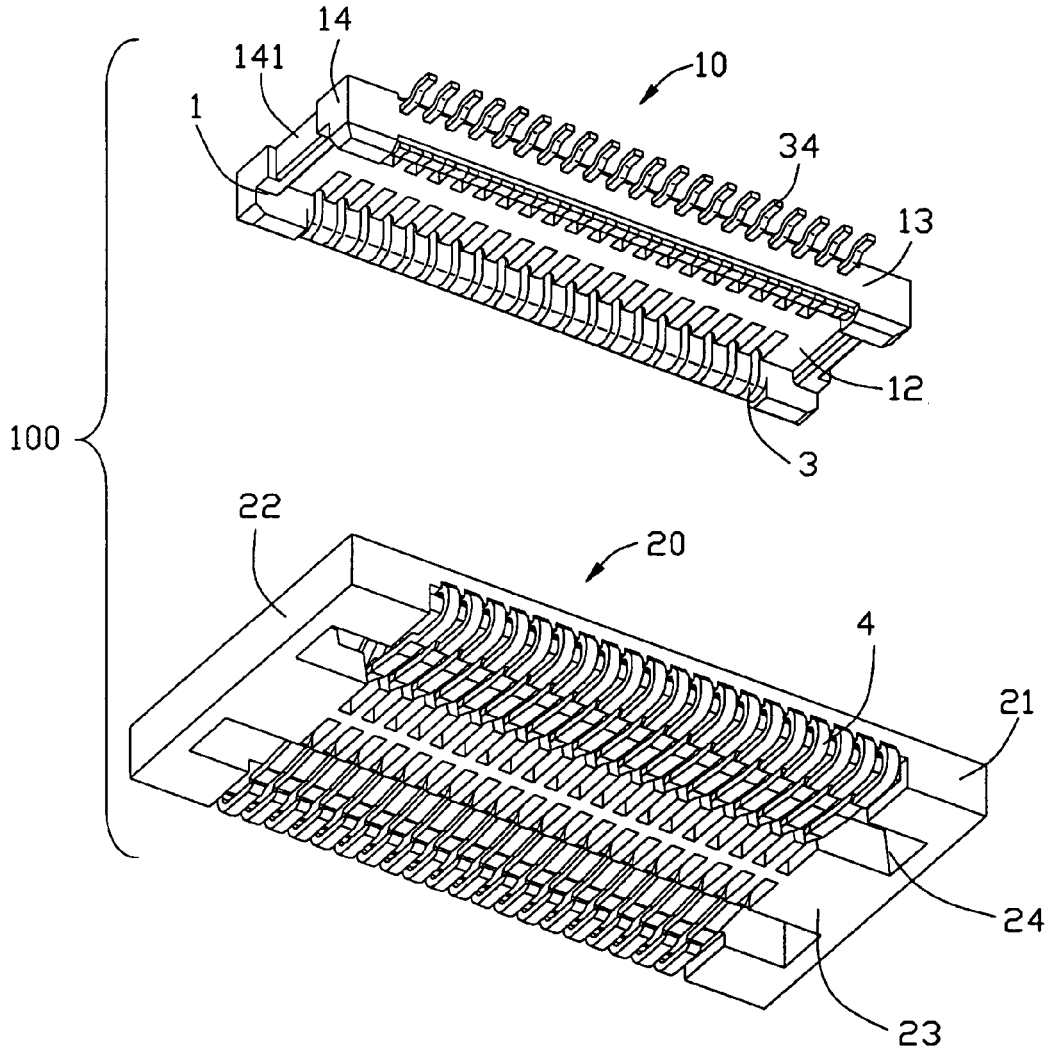
FIG. 3 is a perspective view of the assembled male connector and the assembled female connector as shown in FIG. 1, taken from another aspect.

Referring to FIGS. 1-3, The plug insulator 1 is a substantially rectangular case, comprising a base portion 11, a plurality of side walls 13, 14 extending downwardly from the base portion 11 and encircling therearound to thereby define an elongated cavity 12 therein. The side walls 13, 14 consist of a pair of opposite primary side walls 13, and a pair of combined side walls 14 interconnecting an opposite edge of each primary side wall 13. The base portion 11 has two rows of passageways 111 defined at regular intervals along a length thereof. Each passageway 111 extends in a top-to-bottom direction throughout the base portion 11 for communicating with the cavity 12. Each combined side wall 14 has an engaging recess 141 defined at an outer face thereof.

Referring to FIG. 1, each male terminal 3 is formed with a horizontal body portion 31, an engaging portion 32 perpendicular to one end of the body portion 31, a head portion 33 bending backwardly from the engaging portion 32, and a tail portion 34 extending horizontally from another end of the body portion 31.

Referring to FIGS. 2-3, in assembly of the male connector 10, the male terminals 3 are embedded in the primary side walls 13 of the plug insulator 1 by insert molding, with the engaging portions 32 exposed within corresponding passageways 111 and the cavity 12. The tail portions 34 of the male terminals 3 extend outwardly from an upper portion of the primary side walls 13 for surface mounting onto the first PCB.

Referring to FIG. 1, the female connector 20 comprises a receptacle insulator 2, and a plurality of female terminals 4 assembled to the receptacle insulator 2.

The receptacle insulator 2 comprises an island portion 23, a pair of opposite primary periphery walls 21 and a pair of opposite combined periphery walls 22 interconnected together to surround the island portion 23. The island portion 23 is formed with a pair of connection portion 232 at opposite ends thereof for connecting with a central portion of the combined periphery walls 22. A pair of elongated slots 24 are respectively defined between opposite sides of the island portion 23 and corresponding primary periphery wall 21. The island portion 23 has two rows of grooves 231 communicating with the slots 24 defined at regular intervals lengthwise along an outer surface thereof. Each primary periphery wall 21 defines thereon a plurality of first channels 211 preferably aligning with the grooves 231. Each first channel 211 extends along a transverse direction.

Figure 4:
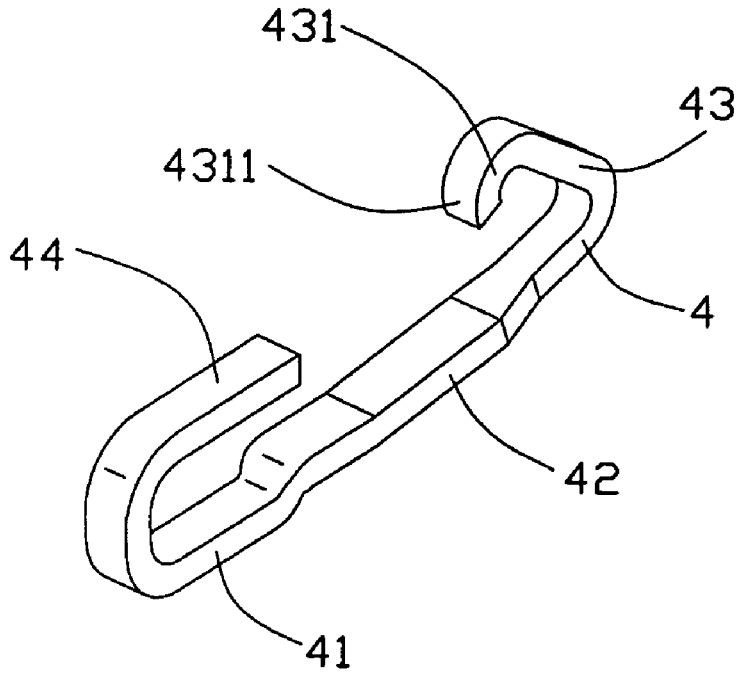
FIG. 4 is a perspective view of the female connector as shown in FIG. 1.

Referring to FIG. 4, the female terminal 4 in accordance with a first embodiment of the present invention comprises a horizontal first soldering portion 41, a first insertion portion 44 bent upwardly then backwardly horizontally from a free end of the first soldering portion 41, a first resilient beam 42 extending forwardly from another free end of the first soldering portion 41, and a V-shaped first compressible portion 43 extending forwardly and then inclining backwardly. The combination of the first soldering portion 41 and the first insertion portion 44 is configured as an "U" shape. The first compressible portion 43 has a first contact portion 431 having a smooth curved first guiding face 4311 formed at a free end thereof.

Referring to FIGS. 2-3, in assembly of the female connector 20, the female terminals 4 are inserted in the slots 24 firstly. The first soldering tail 41 and the first resilient beam 42 of each female terminal 4 are retained in the slots 24 along a transverse direction. The first compressible portion 43 and the first insertion portion 44 of each female terminal 4 are respectively inserted in corresponding groove 231 and first channel 211.

Figure 5:
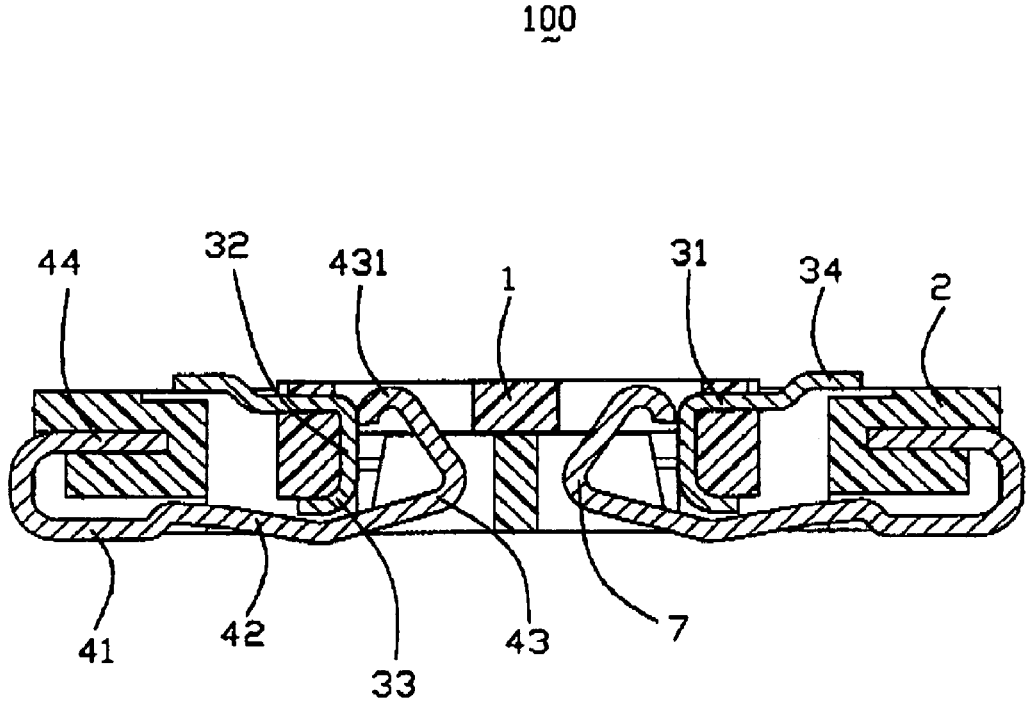
FIG. 5 is a cross-sectional view of the assembled electrical connector assembly as shown in FIG. 1 taken from a center of the electrical connector along a transverse direction.

Referring to FIG. 5, when the male connector 10 is guided into the female connector 20, the first compressible portions 43 of the female terminals 4 are resiliently depressed and the first guiding faces 4311 perform a lead-in function to guide the male connector 10 into the female connector 20. The pair of first primary side walls 13 of the plug insulator 1 are inserted into the slots 24 of the female connector 2, and the island portion 23 of the female terminal 2 is plunged in the cavity 12 of the male connector 1. The engaging recesses 141 of the plug insulator 1 engage with the connection portions 232 of the receptacle insulator 2.

When the male connector 10 is completely inserted into the female connector 20, the first resilient beams 42 of the female terminals 4 project beyond the engaging portions 32 of the male terminals 3 to form a bending portion 7, with the first compressible portions 43 extending backwardly for having an engagement between the first contact portions 431 and corresponding engaging portions 32. The first soldering portions 41 are exposed to a bottom of the female connector 20 for soldering onto the second PCB.

Figure 6:
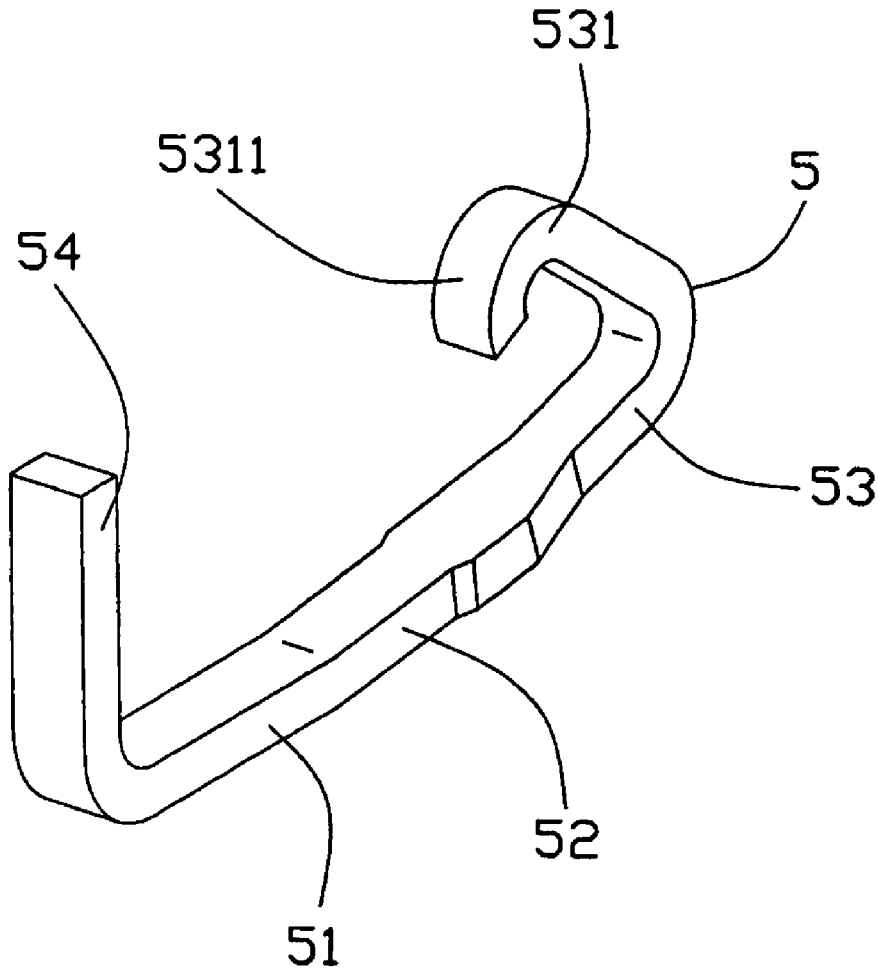
FIG. 6 is a perspective view of a female connector in accordance with a second embodiment of the present invention.
Figure 7:
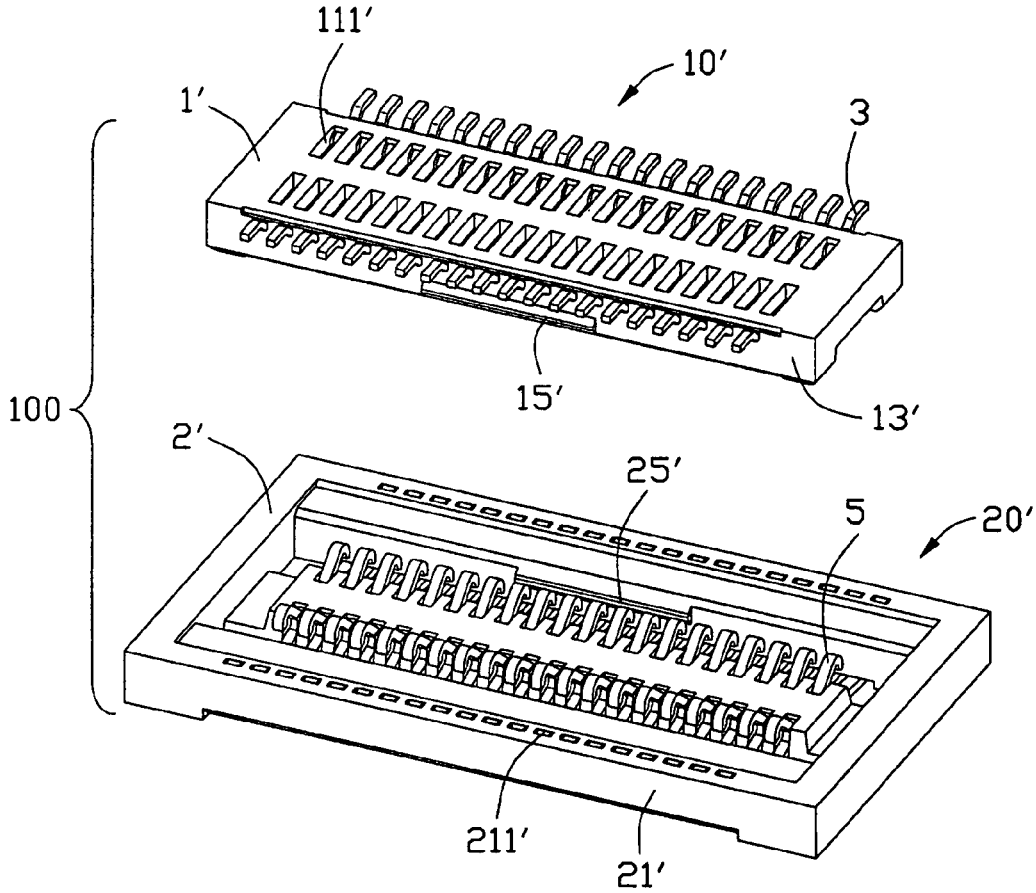
FIG. 7 is a perspective view of an assembled male connector and an assembled female connector in accordance with the second embodiment of the present invention.
Figure 8:
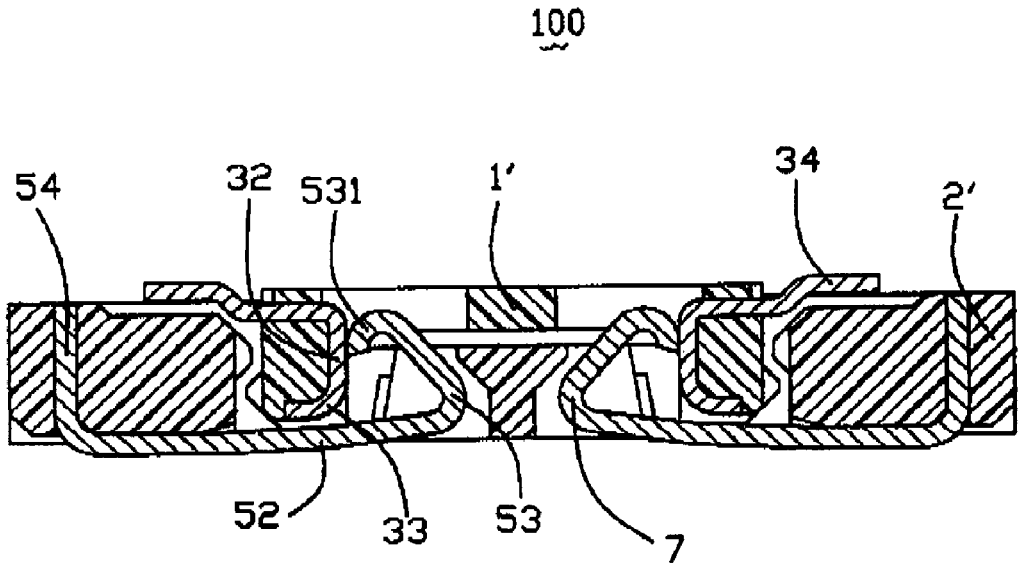
FIG. 8 is a cross-sectional view of the assembled electrical connector assembly as shown in FIG. 7, with the female terminals referred in the second embodiment assembled to, taken from a center of the electrical connector along the transverse direction.

In accordance with a second embodiment of the present invention, a second female terminal 5 shown in FIGS. 6-8, comprises a horizontal second soldering portion 51, a second insertion portion 54 rising perpendicularly to a free end of the second soldering portion 51, a second resilient beam 52 extending forwardly from another free end of the second soldering portion 51 to form a bending portion 7, and a second compressible portion 53 extending forwardly and then inclining backwardly. The second compressible portion 53 has a second contact portion 531 having a smooth curved first guiding face 5311 formed at a free end thereof.

Referring to FIG. 7, each primary periphery wall 21' of the receptacle insulator 2' referred in the second embodiment defines thereon a plurality of second channels 211' extending in a top-to-bottom direction for insertion of corresponding second insertion portions 54 of the female terminals 5 during assembly.

In the second embodiment, the pair of primary side walls 13' of the plug insulator 1' have a pair of first tubers 15' formed on outer surfaces thereof. The pair of primary periphery walls 21' of the receptacle insulator 2' have a pair of second tubers 25' formed in inner surfaces thereof to engage with the first tubers 15' for resisting an accidental unmating of the male connector 10' from the female connector 20'. Except the insertion of second insertion portions 54 into the plug insulator 1', the assembly of the second female terminals 5 and the plug insulator 1' is substantially same to that of the first female terminals 4 and the plug insulator 1.

Figure 9:
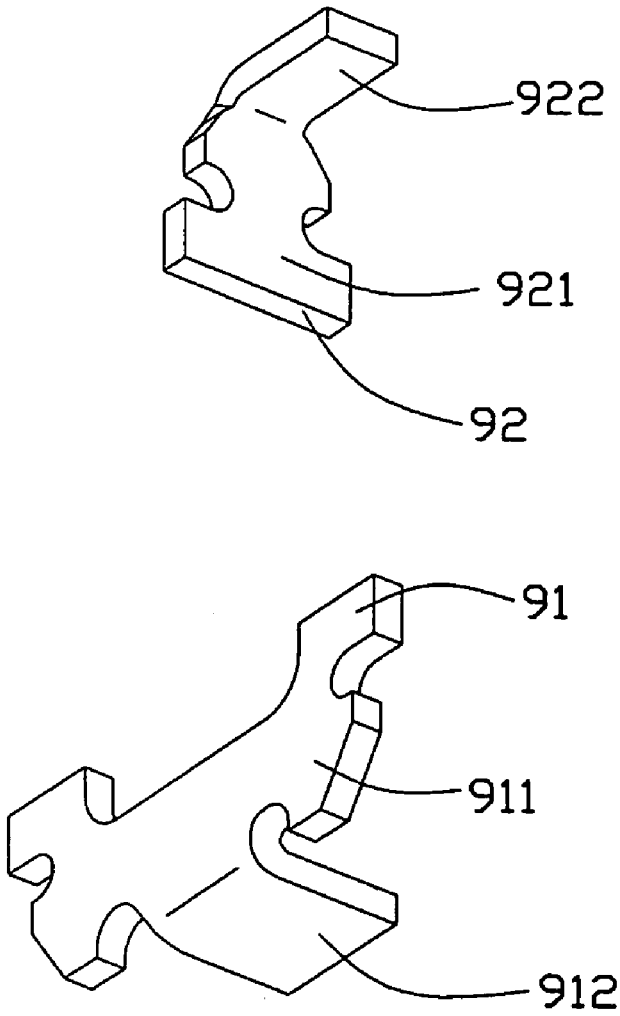
FIG. 9 is a perspective view of a first soldering portion and a second soldering portion, in accordance with the second embodiment of the present invention.
Figure 10:
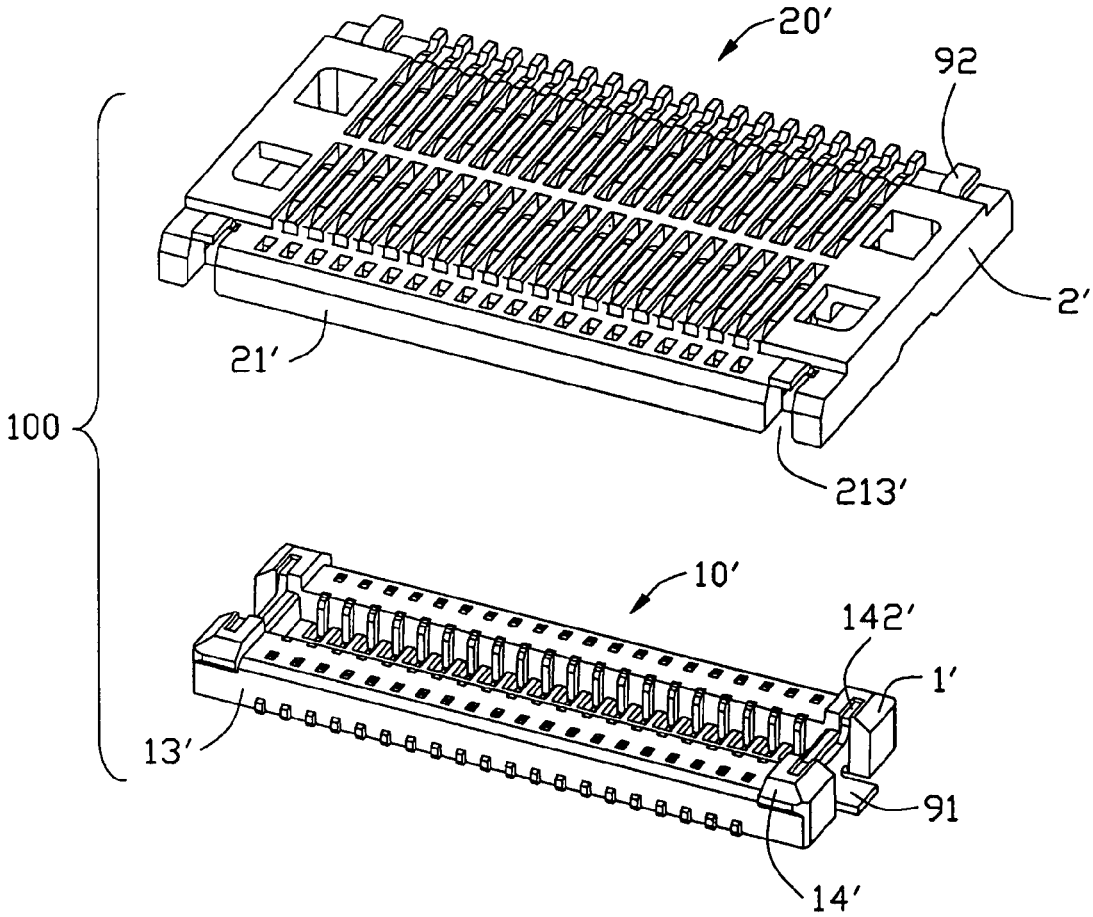
FIG. 10 is a perspective view of the assembled male connector and the assembled the female connector, on which the first and the second soldering portions are mounted.

Referring to FIGS. 9-10, the male connector 10' comprises a pair of insertion recesses 142' defined on the combined side walls 14', and a pair of first soldering portions 91 accommodated in the insertion recesses 142. The first soldering portion 91 has a body portion 911 inserted in the insertion recess 142, and a soldering tail 912 perpendicular to the body portion 911 and extending outwardly for soldering onto the first PCB.

The female connector 20' comprises two pairs of insertion recesses 213' defined on opposite ends of the primary periphery walls 21', and two pairs of second soldering portions 92 accommodated in the insertion recesses 213'. The second soldering portion 92 has a body portion 921 inserted in the insertion recess 213', and a soldering tail 922 perpendicular to the body portion 921 and extending outwardly for soldering onto the second PCB.

Figure 11:
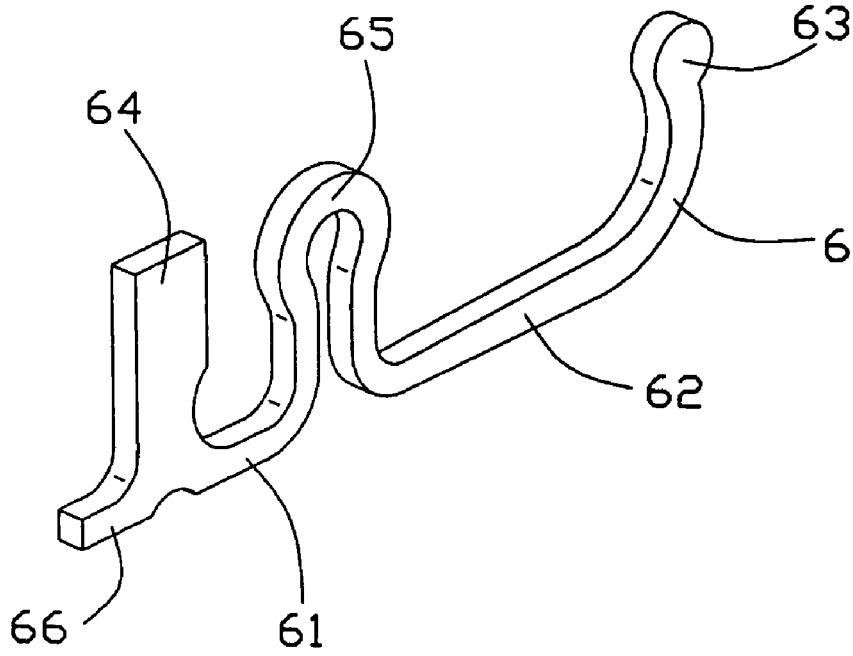
FIG. 11 is a perspective view of the female terminal, in accordance with the third embodiment of the present invention.
Figure 12:
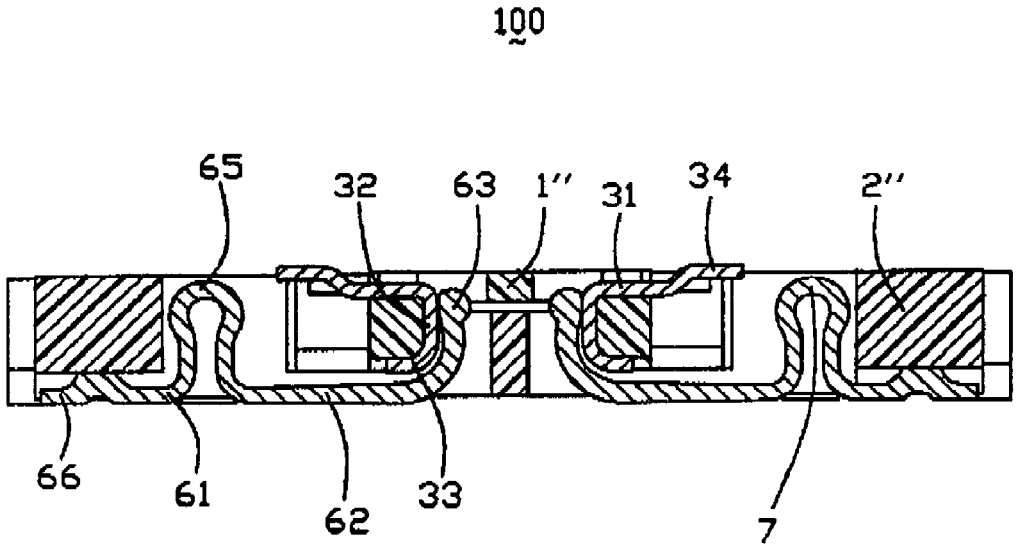
FIG. 12 is a cross-sectional view of the assembled electrical connector assembly similar to the FIG. 5, with the female terminals referred in the first embodiment replaced by the female terminals referred in the third embodiment.

Referring to FIGS. 11-12, a third female terminal in accordance with a third embodiment of the present invention comprises a horizontal body portion 61, an inverted U-shaped third compressible portion 65 extending from one end of the body portion 61, an L-shaped third resilient beam 62, a third insertion portion 64 and a third soldering portion 66 respectively extending perpendicularly and horizontally from another end of the body portion 61. The third resilient beam 62 has one end thereof connecting to the third compressible portion 65, and another end thereof extending forwardly and then upwardly. The third resilient beam 62 has a circular third contact portion 63 formed at an upmost thereof. An uppermost of the third compressible portion 65 is defined as a bending portion 7.

Figure 18:
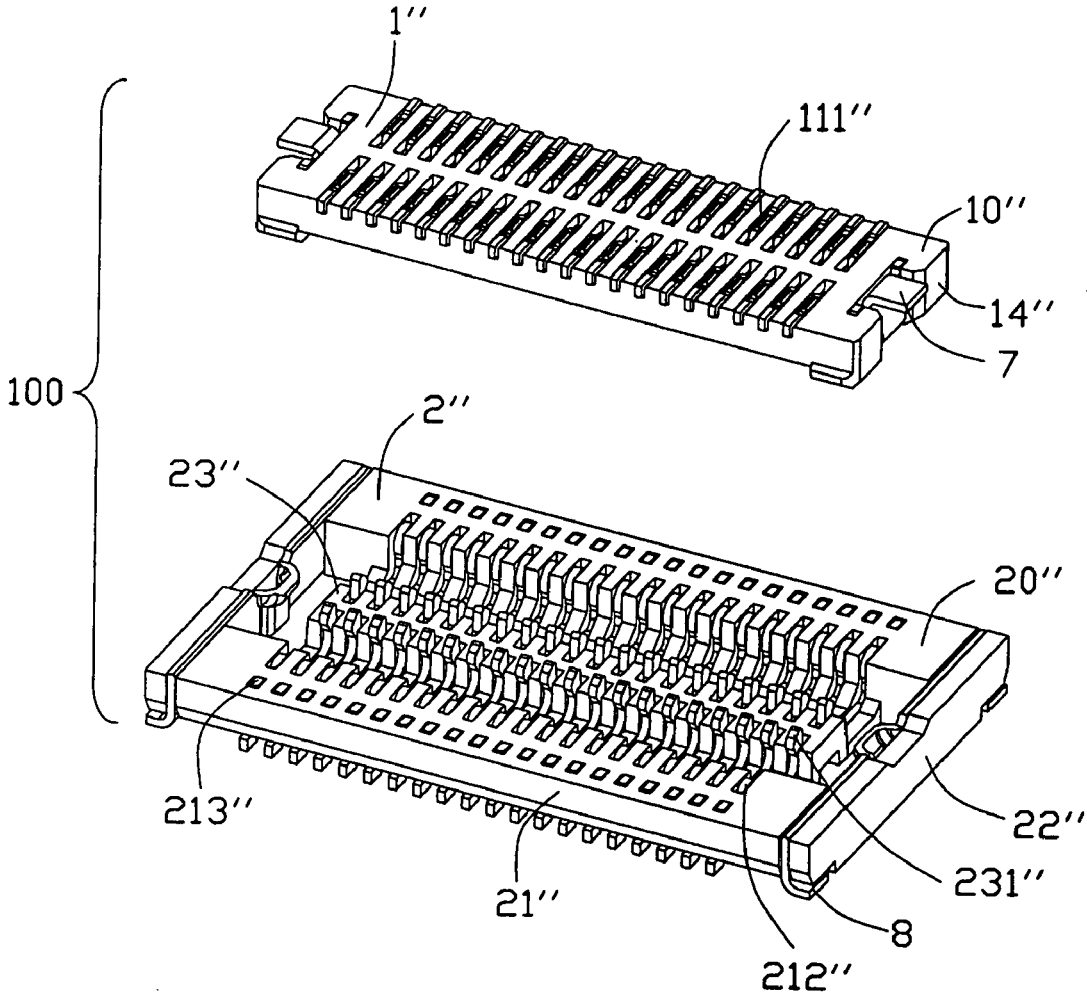
Figure 19:
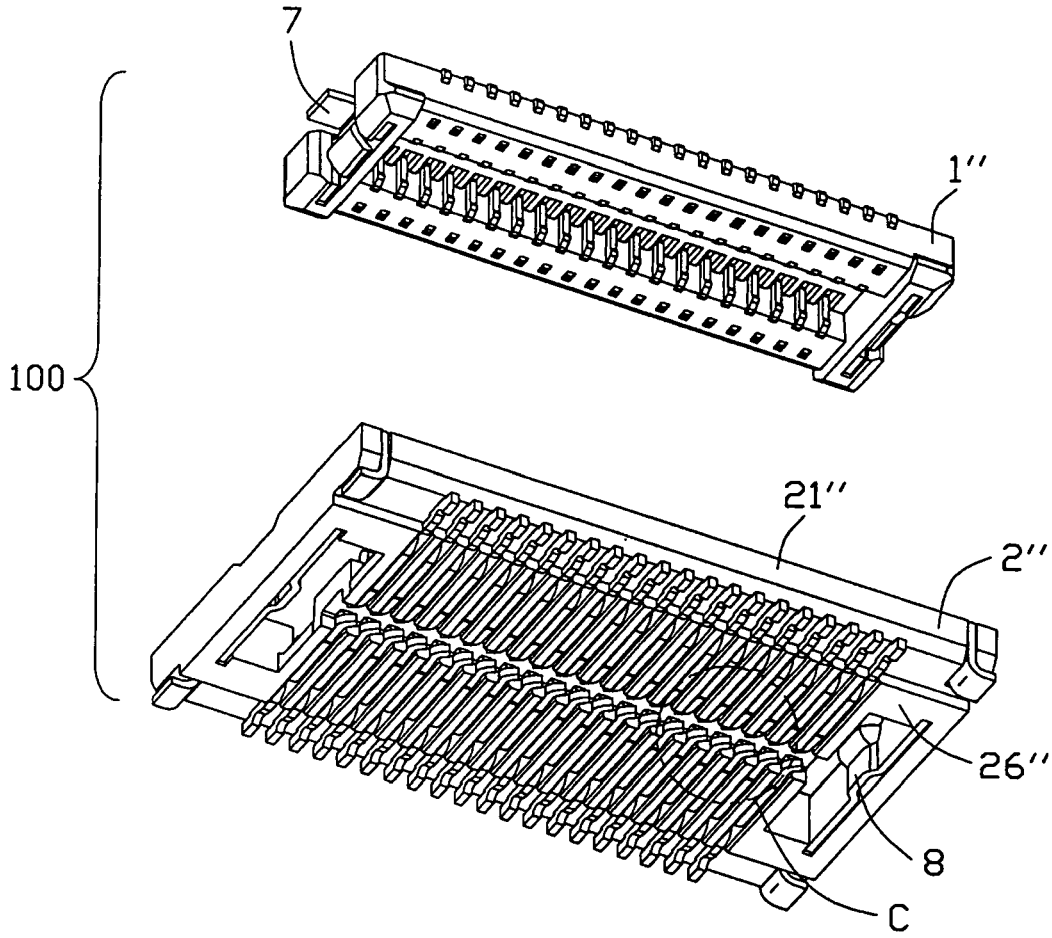
FIG. 19 is a perspective view of the male connector and the female connector similar to the FIG. 18, taken from another aspect.
Figure 20:
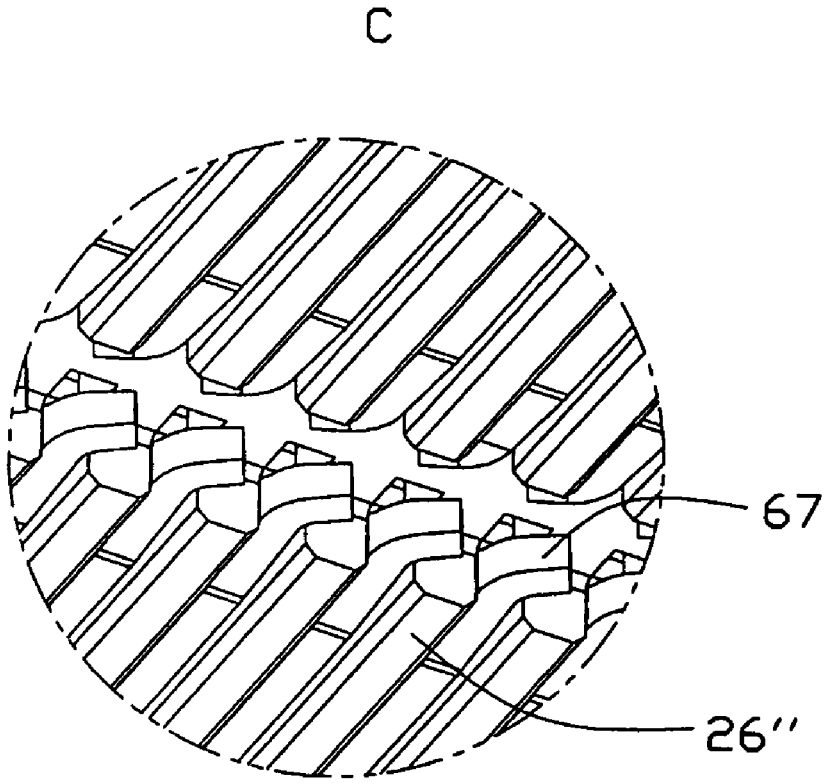
FIG. 20 is partially enlarged view taken within mark C as shown in FIG. 18.
Figure 21:
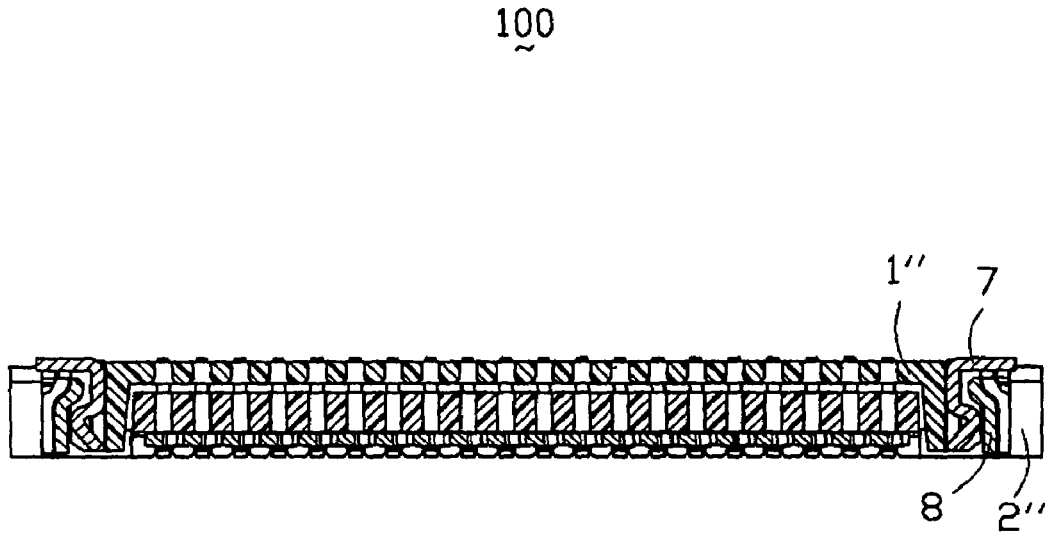
FIG. 21 is a cross-sectional view of the assembled electrical connector assembly as shown in FIG. 18, taken from a center of the electrical connector along a longitudinal direction perpendicular to the transverse direction.

Referring to FIGS. 18-19, the receptacle insulator 2" referred in the third embodiment has a bottom wall 26". Each primary periphery wall 21" of the receptacle insulator 2" defines thereon a plurality of third channels 213" extending in a top-to-bottom direction for insertion of corresponding third insertion portions 64 of the female terminals 6 during assembly. The primary periphery wall 21" of the receptacle insulator 2" has a plurality of fourth channels 212" preferably aligned with corresponding second grooves 231" defined in an inner surface thereof. The third compressible portion 65 of the female terminal 6 is retained in the fourth channels 212". The third resilient beam 62 of the third female terminal 6 is partially retained in the second grooves 231" and exposed near an outer surface of the engaging portion 32 of the male terminal 3, with the third contact portion 63 in contact with corresponding engaging portion 32.

Referring to FIGS. 14, 15, 19, 20, said female terminal could be formed with a retention portion 67 extending laterally from a lower portion of the resilient beam 62 for having an interference with the bottom wall 26" of the receptacle insulator 2".

Figure 13:
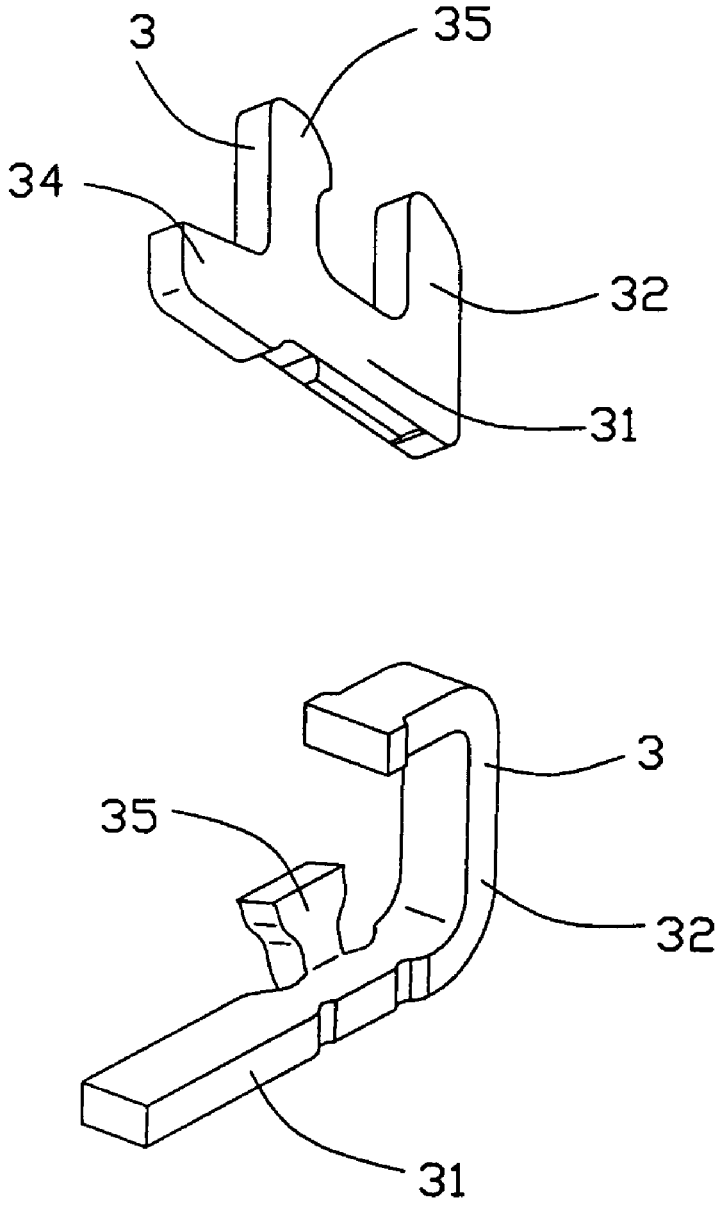
FIG. 13 is a perspective view of another two types of the plug terminal different to the plug terminal shown in FIG. 1.
Figure 14:
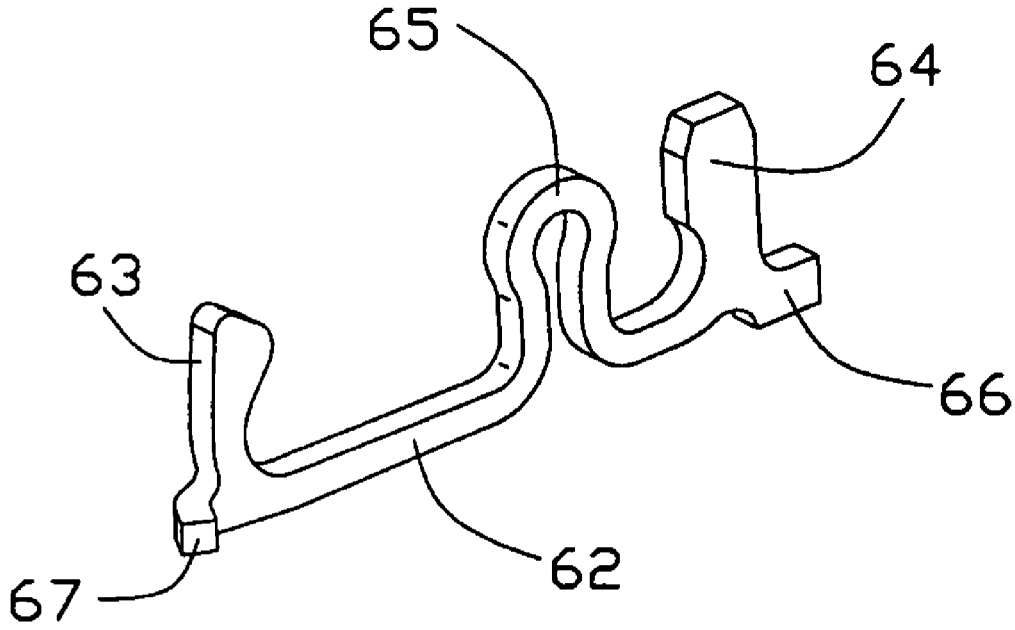
FIG. 14 is a perspective view of another type of the female terminal different to the female terminal shown in FIG. 11.
Figure 15:
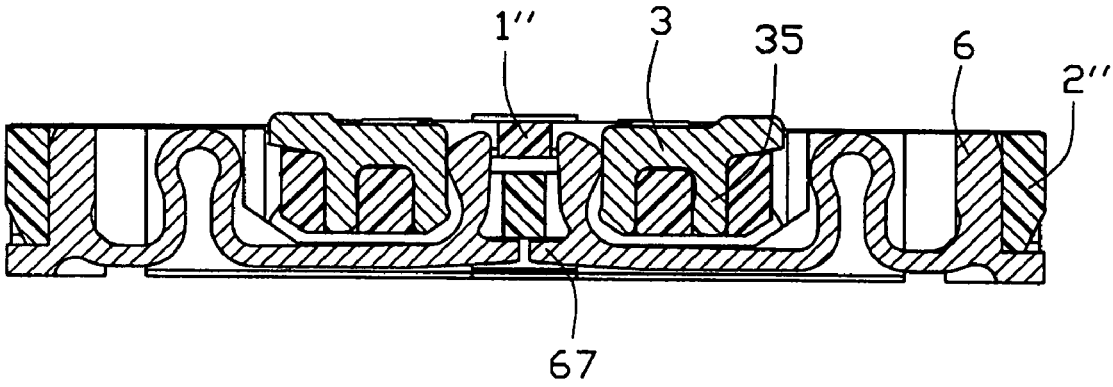

In the third embodiment, referring to FIG. 13, the male terminal 3 could be formed with a retention portion 35 perpendicularly to a substantially middle portion of the body portion 31 and cantilevered to the engaging portion 32. Referring to FIG. 15, the plug insulator 1" has a plurality of slots (not shown) for insertion of the retention portions 35. Naturally, referring to FIG. 13, the retention portion 32 could also be formed on the body portion 31 adjacent to the engaging portion 32. The retention portion 32 projects obliquely laterally to have an interference with the female insulator 2".

Referring to FIGS. 16-21, the male connector 10" referred in the third embodiment comprises a pair of first locking portions 7 mounted on the combined side walls 14" of the plug insulator 1". The first locking portion 7 comprises a body portion 71 inserted into combined side walls 14", a soldering tail 73 extending perpendicularly from a center of the body portion 71, and an U-shaped projecting portion 72 projecting toward the extending direction of the soldering tail 73.

Figure 16:
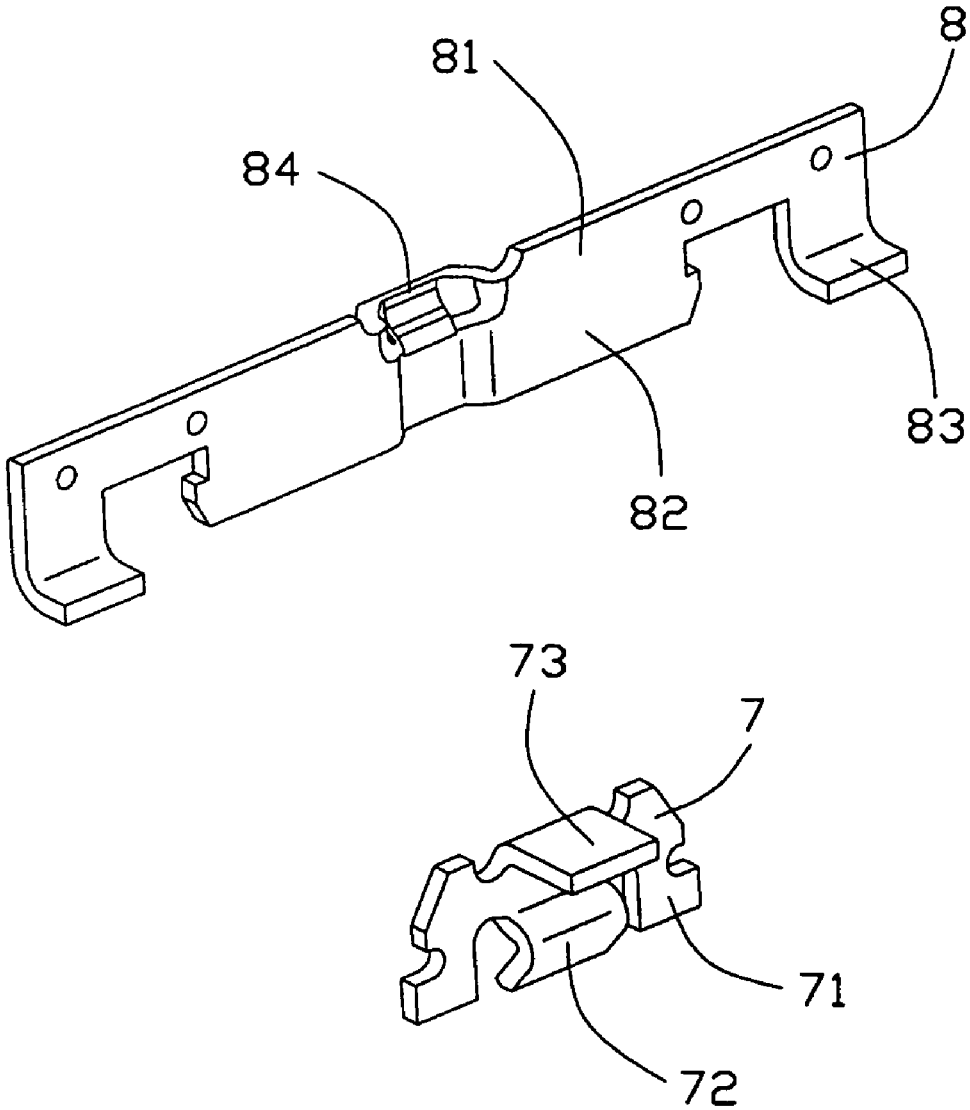
FIG. 16 is a perspective view of a first locking portion and a second locking portion, in accordance with the third embodiment of the present invention.

The female connector 20" referred in the third embodiment is provided with a pair of second locking portions 8 assembled to the pair of combined periphery walls 22" of the receptacle insulator 2". Referring to FIG. 16, each second locking portion 8 comprises a body portion 81 inserted in the combined periphery wall 22" along a width of the receptacle insulator 2", a pair of soldering tails 83 extending perpendicularly from a lower portion of opposite sides of the body portion 81, a pair of soldering feet 82 extending downwardly from the lower portion of the body portion 81, and a protrusion 84 connecting the pair of soldering feet 82 together and projecting toward another direction opposite to the extending direction of the soldering tails 83 for engaging with the projecting portion 72 in the process of mating. The engagement between the projecting portion 72 and the protrusion 84 play a locking function of the male connector 10" to the female connector 20". The soldering tails 73, 83 and the soldering feet 82 are used to be soldered on to corresponding PCB.

Figure 17:
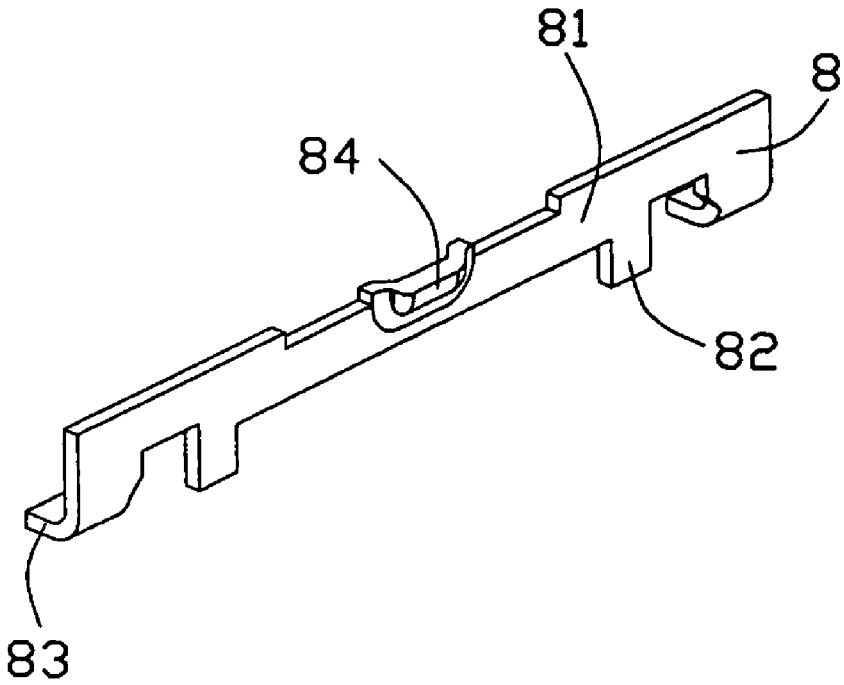
FIG. 17 is a perspective view of another type of the second locking portion different to the second locking portion shown in FIG. 16.

Naturally, referring to FIG. 17, the protrusion 84 could be formed on the body portion 81, and the soldering feet 82 could be separated from each other.

However, the disclosure is illustrative only, changes may be made in detail, especially in matter of shape, size, and arrangement of parts within the principles of the invention.

What is claimed is:

1. An electrical connector assembly for connecting a first and a second circuit boards, comprising:

a male connector for electrically connecting to the first circuit board, comprising:

a plug insulator having a base portion, a plurality of side walls surrounding the base portion to define a cavity therein, and a plurality of passageways communicating with the cavity and extending throughout the base portion; and a plurality of male terminals retained in corresponding passageways, each male terminal comprising an engaging portion exposed in the passageway and a tail portion for soldering onto the first circuit board; and a female connector for electrically connecting to the second circuit board, comprising:

a receptacle insulator for mating with said plug insulator, the receptacle insulator comprising an island portion defining a plurality of grooves, a plurality of periphery walls surrounding the island portion and defining a plurality of channels, and a pair of slots defined between opposite sides of the island portion and corresponding periphery walls for insertion of corresponding side walls of the plug insulator, and a plurality of female terminals retained in the slots, each female terminal comprising a contact portion for contacting with a corresponding engaging portion of the male terminal and inserted into the passageway within the base portion, a resilient portion resiliently connecting to the contact portion, a soldering portion for soldering onto the second circuitboard and an insertion portion inserted into the channel, said resilient portion comprising a horizontal resilient beam and a bent compressible portion resiliently connecting to the resilient beam and having a bending portion away from the engaging portion of corresponding male terminal for providing elasticity to the female terminal.

2. The electrical connector assembly as claimed in claim 1, wherein said compressible portion of each female terminal inclines upwardly forwardly beyond the resilient beam and then backwardly to configure itself as a V shape, with the contact portion formed on a free end thereof.

3. The electrical connector assembly as claimed in claim 2, wherein said grooves are defined in two rows and communicate with the slots, and the compressible portions of the female terminals are retained in corresponding grooves, with the contact portions exposed to the slots.

4. The electrical connector assembly as claimed in claim 3, wherein each insertion portion of the female terminal extends upwardly and then horizontally from the soldering portion to make a combination of the insertion portion and the soldering portion shaped as an "U," and each channel extends in a transverse direction for insertion of the insertion portion.

5. The electrical connector assembly as claimed in claim 3, wherein each insertion portion of the female terminal extends upwardly from the soldering portion to make a combination of the insertion portion and the soldering portion shaped as an "L," said soldering portion disposed between the insertion portion and the resilient portion, and each channel extends in a top-to-bottom direction for insertion of the insertion portion.

6. The electrical connector assembly as claimed in claim 1, wherein said female terminal comprises a body portion, from which said insertion portion and the soldering portion respectively extend perpendicularly and horizontally, and wherein said compressible portion is configured as an inverted U shape and connects the body portion to the L-shaped resilient beam, of which the contact portion is formed at an upmost.

7. The electrical connector assembly as claimed in claim 6, wherein said receptacle insulator has a bottom wall, said female terminal is formed with a retention portion extending laterally from the resilient beam for interference fitting with the bottom wall of the receptacle insulator.

8. The electrical connector assembly as claimed in claim 1, wherein each male teal comprises a horizontal body portion, said engaging portion extends perpendicularly to one end of the body portion, and the tail portion extends horizontally from another end of the body portion.

9. The electrical connector assembly as claimed in claim 8, wherein said passageways are defined on the base portion in two rows, and said engaging portions of the male terminals are exposed to the passageways and the cavity.

10. The electrical connector assembly as claimed in claim 9, wherein each male terminal has a retention portion having an interference fit with the plug insulator.

11. The electrical connector assembly as claimed in claim 10, wherein said retention portion projects obliquely from a side edge of the body portion and is disposed adjacent to the engaging portion.

12. The electrical connector assembly as claimed in claim 1, wherein said male connector has a pair of first locking portions mounted on the plug insulator, each first locking portion having an U-shaped projecting portion and a soldering portion, and wherein said female connector comprises a pair of second locking portions mounted on the receptacle insulator, each second locking portion having a plurality of soldering portions and a protrusion engaging with the projecting portion.

13. The electrical connector assembly as claimed in claim 1, wherein said plug connector comprises a pair of insertion recesses defined on the opposite side walls thereof and a pair of first soldering sections, each first soldering portion having a body portion inserted into the insertion recess and a soldering tail extending outwardly.

14. The electrical connector assembly as claimed in claim 13, wherein said receptacle connector comprises two pairs of insertion recesses defined on the opposite periphery walls thereof and four second soldering sections, each second soldering portion having a body portion inserted into the insertion recess and a soldering tail extending outwardly.

15. An electrical connector assembly comprising;

a first connector having a first insulative housing with a plurality of first contacts therein, each of the first contacts defining a first mating section supported by the first housing in a stiff manner when mated;

the first housing defining a first receiving cavity;

a second connector having a second insulative housing with a plurality of second contacts therein, the second housing defining a second receiving cavity with a central island therein, said second receiving cavity receiving the first housing herein while the first cavity receiving the central island therein;

each of the second contacts defining a resilient arm having a curved second mating section extending around the central island and into the first receiving cavity to engage the corresponding first contact, wherein the resilient arm is exposed to a bottom face of the second housing; wherein said resilient arm includes an extended curved section, which is laterally distanced away from the curved second mating section and located in an upper portion of the second receiving cavity of the second housing while being outside of the first housing.

16. The electrical connector assembly as claimed in claim 15, the curved second mating section extends from only the extended curved section.

17. The electrical connector assembly as claimed in claim 16, wherein said extended curved section being of an upside down U-shaped configuration, defines one end toward the curved second mating section and the other end toward a soldering section.

18. The electrical connector assembly as claimed in claim 15, wherein said extended curved section is not engaged with either the first insulative housing or the second insulative housing when the first connector and the second connector are mated with each other.

19. An electrical connector assembly comprising:

a first connector having a first insulative housing with a plurality of first contacts therein, each of the first contacts defining a first mating section supported by the first housing in a stiff manner when mated;

the first housing defining a first receiving cavity;

a second connector having a second insulative housing with a plurality of second contacts therein, the second housing defining a second receiving cavity with a central island therein, said second receiving cavity receiving the first housing herein while the first receiving cavity receiving the central island therein;

each of the second contacts defining a resilient arm having a curved second mating section extending around the central island and into the first receiving cavity to engage the corresponding first contact: wherein the first housing defines a plurality of passageways formed in a bottom wall of the first housing, and a portion of the curved second mating section invades the bottom wall of the first housing and is received in the corresponding passageway.

20. The electrical connector assembly as claimed in claim 19, wherein the passageway extends through a bottom face of the first housing and communicates with an exterior through said bottom face.

* * * * *